US010327085B2

(12) United States Patent
Hiraoka

(10) Patent No.: US 10,327,085 B2
(45) Date of Patent: Jun. 18, 2019

(54) LOUDSPEAKER DIAPHRAGM, MANUFACTURING METHOD FOR THE SAME, AND LOUDSPEAKER INCLUDING THE LOUDSPEAKER DIAPHRAGM

(71) Applicant: Panasonic Intellectual Property Management Co., Ltd., Osaka (JP)

(72) Inventor: Hidetoshi Hiraoka, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 7 days.

(21) Appl. No.: 15/871,415

(22) Filed: Jan. 15, 2018

(65) Prior Publication Data

US 2018/0270595 A1 Sep. 20, 2018

(30) Foreign Application Priority Data

Mar. 14, 2017 (JP) ..... 2017-047955

(51) Int. Cl.

| | |
|---|---|
| ***H04R 25/00*** | (2006.01) |
| ***H04R 31/00*** | (2006.01) |
| ***H04R 9/06*** | (2006.01) |
| ***H04R 9/02*** | (2006.01) |
| ***H04R 1/28*** | (2006.01) |
| ***H04R 7/18*** | (2006.01) |
| ***H04R 7/12*** | (2006.01) |

(52) U.S. Cl.

CPC ..... *H04R 31/003* (2013.01); *H04R 1/288* (2013.01); *H04R 7/125* (2013.01); *H04R 7/18* (2013.01); *H04R 9/02* (2013.01); *H04R 9/025* (2013.01); *H04R 9/06* (2013.01); *H04R 2307/021* (2013.01); *H04R 2307/029* (2013.01); *H04R 2400/11* (2013.01)

(58) Field of Classification Search

CPC ..... H04R 31/003; H04R 1/288; H04R 7/125; H04R 7/18; H04R 9/02; H04R 9/06; H04R 9/025

USPC ..... 381/353

See application file for complete search history.

(56) References Cited

U.S. PATENT DOCUMENTS

2016/0134972 A1 5/2016 Shibuya et al.

FOREIGN PATENT DOCUMENTS

WO 2015/011903 1/2015

OTHER PUBLICATIONS

A. Barton Hinkle. "Your Lobster Leftovers Could Serve up a Substitute for Plastics." Reason.com, Apr. 16, 2018, URL: https://reason.com/archives/2018/04/16/animal-chitin-may-help-us-move-beyond-pl (Year: 1998).*

* cited by examiner

*Primary Examiner* — Phylesha Dabney

(74) *Attorney, Agent, or Firm* — Greenblum & Bernstein, P.L.C.

(57) ABSTRACT

A loudspeaker diaphragm includes a base layer and a coating layer. The base layer contains natural fibers. The coating layer is formed on at least one of surfaces of the base layer. The coating layer is composed of chitin nanofibers each having a higher elastic modulus than that of the base layer.

11 Claims, 6 Drawing Sheets

LOUDSPEAKER DIAPHRAGM, MANUFACTURING METHOD FOR THE SAME, AND LOUDSPEAKER INCLUDING THE LOUDSPEAKER DIAPHRAGM

BACKGROUND

1. Technical Field

The present disclosure relates to a diaphragm, a method of manufacturing the diaphragm, and a loudspeaker including the diaphragm.

2. Description of the Related Art

Loudspeaker diaphragms are demanded to have lightweight, high rigidity, and appropriate internal loss. WO2015/011903 discloses a loudspeaker diaphragm including a base layer and a coating layer. The base layer contains natural fibers, such as cellulose fibers. The coating layer, which is composed of cellulose nanofibers, is formed on at least one surface of the base layer.

The natural fibers in the base layer can be made from wood or non-wood pulp, or a combination of both. The non-wood pulp is an aggregate of fibers obtained from bamboo or other plants. The cellulose nanofiber in the coating layer is cellulose-containing fiber with nano diameter. The above-mentioned WO2015/011903 discloses, as examples of cellulose nanofiber, nata de coco powder and nano-scale miniaturized bamboo fiber.

SUMMARY

The present disclosure provides a loudspeaker diaphragm that includes a coating layer on at least one surface of a base layer, thereby having a good balance of physical properties, that is, both high elastic modulus and appropriate internal loss.

The loudspeaker diaphragm according to the present disclosure includes a base layer having a first surface and a second surface, and a coating layer on at least one of the first and second surfaces of the base layer. The base layer contains natural fibers. The coating layer is composed of chitin nanofibers each having a higher elastic modulus than that of the base layer.

According to the method of manufacturing a loudspeaker diaphragm according to the present disclosure, a chitin nanofiber water dispersion is sprayed onto at least one of first and second surfaces of a base layer containing natural fibers to form an intermediate product, and the intermediate product is hot-pressed into a shape of a diaphragm.

The loudspeaker according to the present disclosure includes the above-described diaphragm, an edge, a magnetic circuit, a frame, a voice coil, and a damper. The edge is coupled to the outer periphery of the diaphragm. The magnetic circuit, which is provided with a magnetic gap, is formed of a yoke, a magnet, and a plate. The frame is attached to the magnetic circuit and supports the outer periphery of the diaphragm via the edge. The voice coil has a first end attached to the diaphragm and a second end wound with a coil disposed in the magnetic gap. The damper is coupled to the frame and the voice coil.

The molecule of the chitin nanofiber is composed of a fewer number of OH groups than in the molecule of the cellulose nanofiber in the coating layer of loudspeakers known in the art, and acetyl groups, which are less strongly hydrogen-bonded than OH groups. The coating layer composed of such chitin nanofibers has a long intermolecular distance, facilitating the molecular motion. Thus, in the coating layer, the rigid main structure maintains the hardness of the diaphragm, and the molecular motion increases the internal loss of the diaphragm.

DETAILED DESCRIPTION OF PREFERRED EMBODIMENT

Prior to describing an exemplary embodiment of the present disclosure, problems known in the art will now be described briefly.

Loudspeaker diaphragms including a coating layer of cellulose-nanofibers and a base layer have high elastic modulus. As a result, loudspeakers including such a highly rigid diaphragm can have the higher limit frequency as frequency response, and thus produce clearer sound.

However, the internal losses of these diaphragms tend to be lower than expected, in spite of their high rigidities. Loudspeakers including a diaphragm with a low internal loss are likely to cause peaks and dips in frequency response. These characteristics can cause reverberation of sound, producing distorted and non-expressive sound. To avoid this, loudspeaker diaphragms are expected to have a better balance of physical properties.

The exemplary embodiment of the present disclosure will now be described with reference to drawings.

Figure 1:
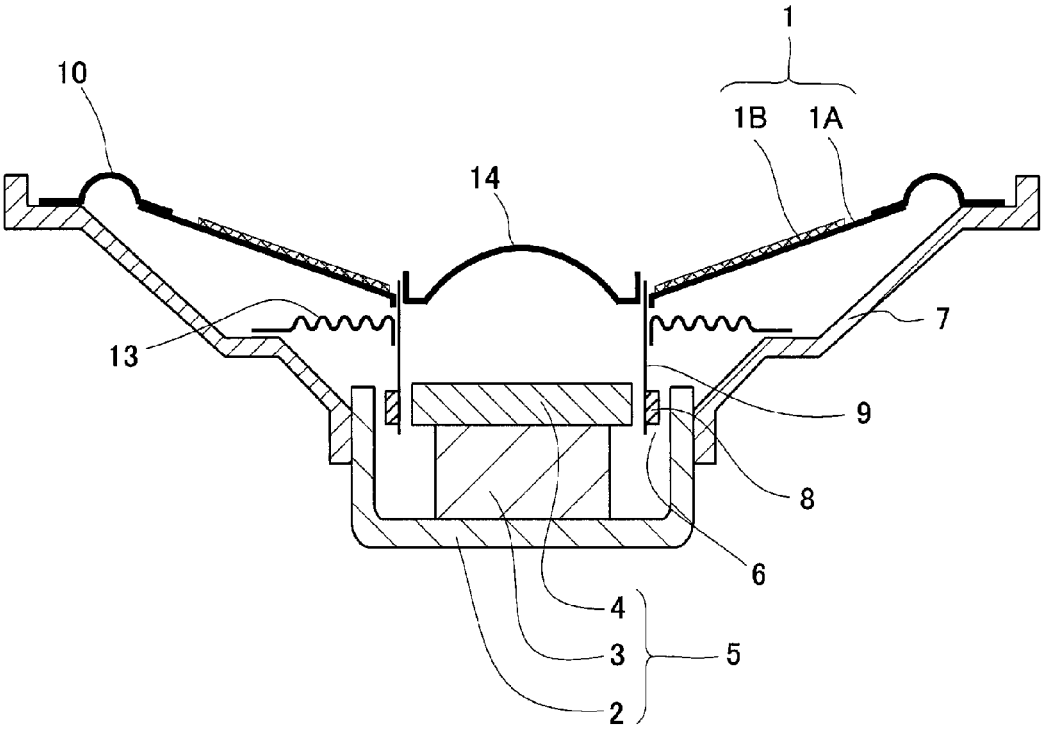
FIG. 1 is a sectional view of a loudspeaker including a loudspeaker diaphragm according to an exemplary embodiment of the present disclosure.

FIG. 1 is a sectional view of a loudspeaker including diaphragm 1 according to the exemplary embodiment of the present disclosure.

This loudspeaker includes edge 10, cone-shaped diaphragm 1, magnetic circuit 5, frame 7, voice coil 9, and damper 13. Edge 10 is coupled to the outer periphery of diaphragm 1. Magnetic circuit 5 includes yoke 2, magnet 3, and plate 4. Magnetic circuit 5 has uniform magnetic gap 6 between the inner periphery of yoke 2 and the outer periphery of plate 4. Frame 7 is attached to yoke 2 of magnetic circuit 5 near magnetic gap 6 in such a manner as to support the outer periphery of diaphragm 1 via edge 10. To be more specific, the bottom of frame 7 is coupled to the outer periphery of yoke 2, and the top of frame 7 is coupled to the outer periphery of diaphragm 1 via edge 10. Voice coil 9 has a first end, which is attached to the reverse surface of diaphragm 1, and a second end, which is wound with coil 8 and disposed in magnetic gap 6. The first end of voice coil 9 is coupled to the center of diaphragm 1. Damper 13 is coupled to voice coil 9 and frame 7. Diaphragm 1 may include, in its central region, dust cap 14 to prevent the entry of dust into magnetic gap 6.

Figure 2:
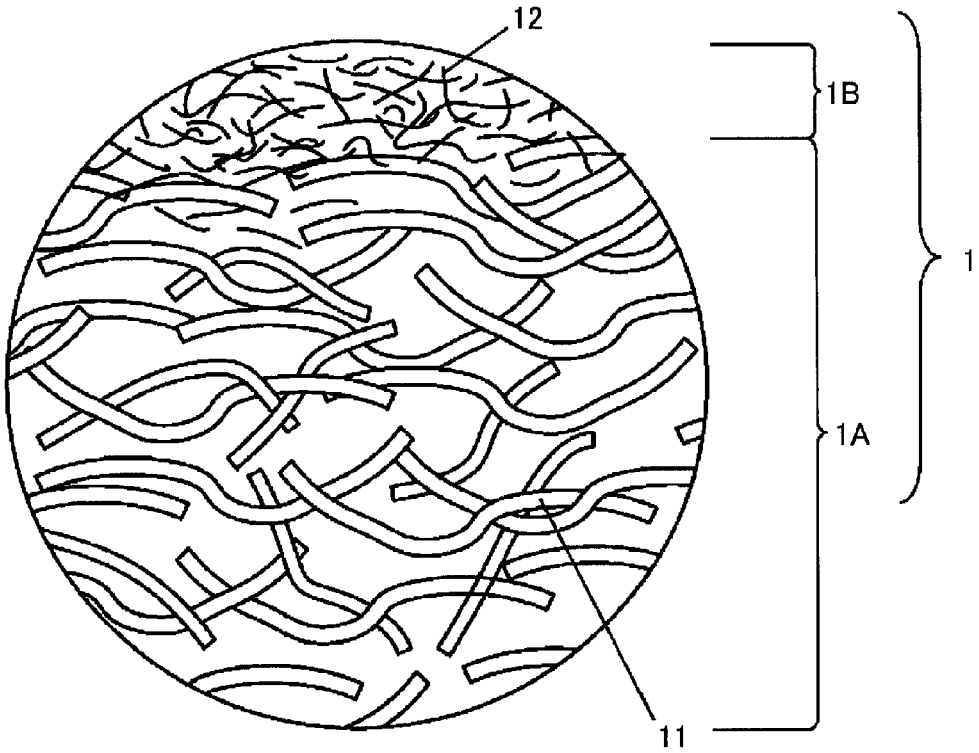
FIG. 2 is an enlarged schematic sectional view of the loudspeaker diaphragm according to the exemplary embodiment.

FIG. 2 is an enlarged schematic sectional view of diaphragm 1.

Diaphragm 1 includes base layer 1A mainly composed of natural fibers 11, and coating layer 1B formed on the reverse side (surface) of base layer 1A from magnetic circuit 5.

Natural fibers 11 can be either wood pulp, such as cellulose fiber or non-wood pulp, or a combination of both. Non-wood pulp is an aggregate of fibers obtained from bamboo or other plants. Coating layer 1B is mainly composed of chitin nanofibers 12 higher in elastic modulus than base layer 1A. Chitin nanofiber 12 is a polysaccharide composed of linearly-linked acetylglucosamine units. To be more specific, chitin nanofibers 12 are derived from crab shell and have an average diameter in a range from 10 nm to 20 nm, inclusive.

Figure 3A:
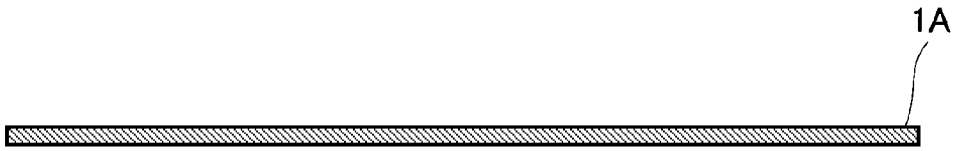
FIGS. 3A to 3C are sectional views showing manufacturing processes of the loudspeaker diaphragm according to the exemplary embodiment.
Figure 3B:
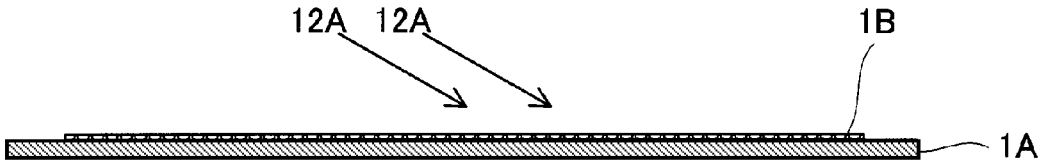
Figure 3C:
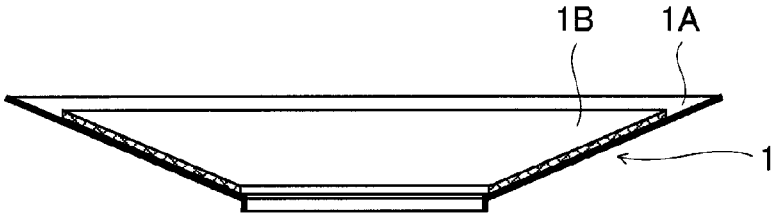

FIGS. 3A to 3C show the manufacturing processes of diaphragm 1.

First, wood or non-wood pulp is beaten into raw paper with a fiber diameter of, for example, 13 μm or so. The raw paper is made into stacked sheets of paper. The stacked sheets are subjected to vacuum extraction to prepare base layer 1A shown in FIG. 3A until the surface of base layer 1A remains wet to some extent.

The above-described beating is performed as follows. The pulp is put into a beater together with at least one of the waterproof agents that are fluorine- and paraffin-based emulsions. Next, the pulp is beaten, with the waterproof agent being adsorbed on the pulp. Further, a resin emulsion may be added to the beater to improve the waterproofness of base layer 1A. The above-mentioned waterproof agent may be replaced by a silicon- or silane-based waterproof agent.

Examples of the resin emulsion include epoxy-, acrylic-, and ester-based synthetic resins, such as vinyl acetate polymers, acrylic ester copolymers, and ethylene-vinyl acetate-acrylic acid copolymers.

Next, chitin nanofiber water dispersion 12A is sprayed onto base layer 1A to form coating layer 1B as shown in FIG. 3B. Each of the chitin nanofibers in coating layer 1B is a polysaccharide composed of linearly-linked acetylglucosamine units, and have an average diameter in a range from 10 nm to 20 nm, inclusive.

Finally, an intermediate product shown in FIG. 3B, which consists of base layer 1A and coating layer 1B formed on one side (surface) of base layer 1A, is hot-pressed into the shape of a cone diaphragm while being dried. Thus, diaphragm 1 is produced.

Subsequently, voice coil 9 and edge 10 are attached to diaphragm 1, and diaphragm 1 is put into frame 7 to complete the loudspeaker.

Diaphragm 1 prepared as Example has the following specifications. The proportion of the waterproof agent with respect to the raw paper is in a range from 5 to 10 wt %, inclusive. The proportion of the chitin nanofibers in dispersion 12A is 1 wt %. The proportion of coating layer 1B in the total thickness of diaphragm 1 is in a range from 3.5 to 6%, inclusive. A diaphragm prepared as Comparative Example A includes a base layer, but not a coating layer. In other words, the diaphragm of Comparative Example A is identical to base layer 1A of Example. A diaphragm prepared as Comparative Example B includes a coating layer composed of cellulose nanofibers. The thickness of the coating layer of Comparative Example B is in a range from 3.5 to 6%, inclusive, of the entire thickness of the diaphragm, as same as Example. The other conditions are common to Example and Comparative Examples A, B. The diaphragms of Example and Comparative Examples A, B are measured for elastic modulus and internal loss. The measurement results are shown in Table 1.

TABLE 1

| | Elastic Modulus (GPa) | Internal Loss |
|---|---|---|
| Comparative Example A (base layer alone) | 2.0 | 0.040 |
| Comparative Example B (base layer + cellulose nanofibers) | 2.7 | 0.035 |
| Example (base layer + chitin nanofibers) | 3.5 | 0.040 |

As seen from Table 1, the elastic modulus of Example is 3.5 GPa, which is greater than the elastic modulus (2.7 GPa) of Comparative Example B using the coating layer composed of cellulose nanofibers. Furthermore, the internal loss of Example is 0.040, which is the same as that of Comparative Example A using the base layer alone and is greater than that (0.035) of Comparative Example B. Thus, the diaphragm of Example has both a high rigidity characterized by an elastic modulus of 3.5 GPa and an appropriate internal loss.

The diaphragm of Example further has a better waterproofness than that of Comparative Example B because hydrophobic acetyl groups remain on the surface of coating layer 1B.

Figure 4:
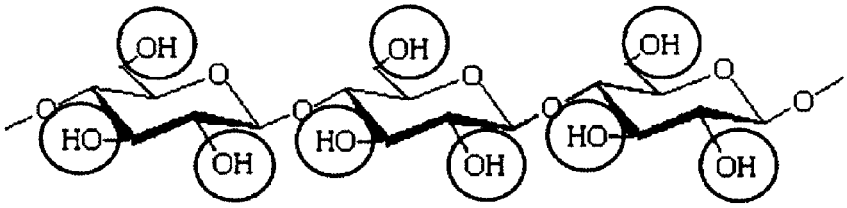
FIG. 4 shows a chemical structure of a molecule of cellulose nanofiber.
Figure 5:
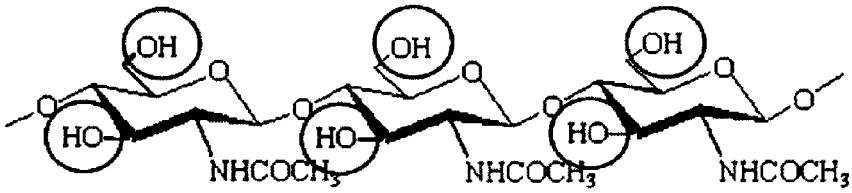
FIG. 5 shows a chemical structure of a molecule of chitin nanofiber.

FIGS. 4 and 5 show the chemical structures of molecules of cellulose nanofiber and chitin nanofiber, respectively.

Chitin nanofiber is composed of OH groups and acetyl groups, which are less strongly hydrogen-bonded than OH groups. Chitin nanofiber also contains fewer OH groups than cellulose nanofiber, and thus fewer hydrogen-bonds are formed between the molecules. This seems to be the reason that coating layer 1B composed of chitin nanofibers 12 used in diaphragm 1 has a longer intermolecular distance, facilitating the molecular motion, and that the rigid main structure of coating layer 1B maintains the hardness of diaphragm 1, allowing the molecular motion to increase the internal loss of the diaphragm.

In the exemplary embodiment, coating layer 1B composed of chitin nanofibers is formed only on one surface of base layer 1A; alternatively however, coating layers 1B can be formed on both surfaces of base layer 1A.

When coating layers 1B are formed on both surfaces of base layer 1A, coating layers 1B can be more effective, allowing the loudspeaker to have the higher limit frequency and to produce clearer sound.

Figure 6:
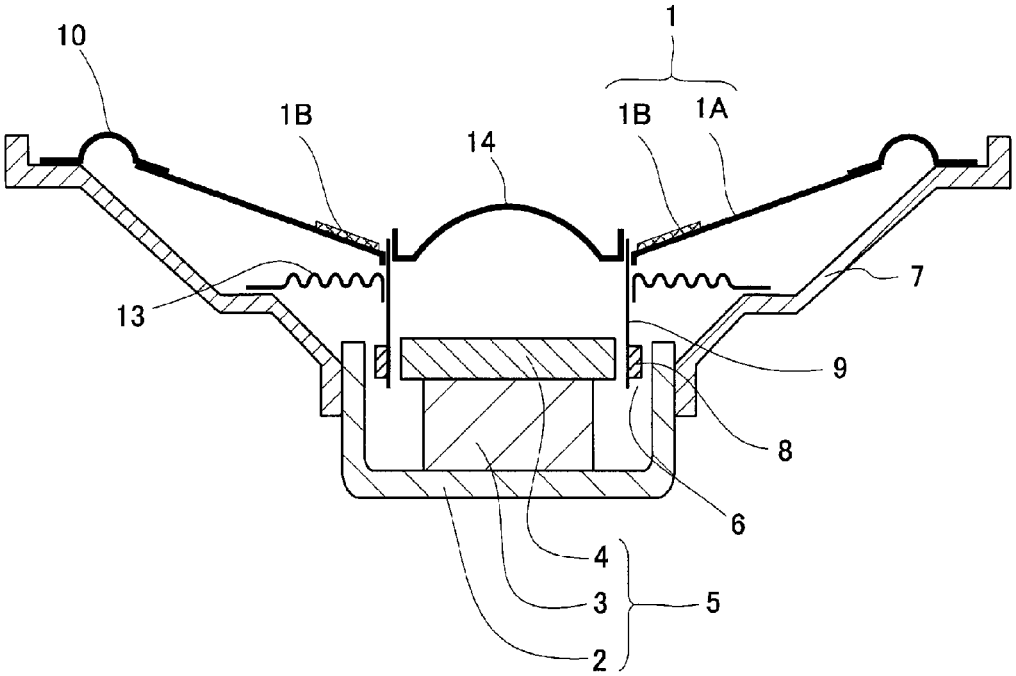
FIG. 6 is a sectional view of another loudspeaker according to the exemplary embodiment of the present disclosure.

Coating layer 1B is formed on the entire surface of base layer 1A in diaphragm 1 in FIG. 1; alternatively, however, coating layer 1B may be formed only on the central portion of diaphragm 1 as shown in FIG. 6. FIG. 6 is a sectional view of another loudspeaker according to the exemplary embodiment. In this loudspeaker, ring-shaped coating layer 1B is formed around the central portion of base layer 1A in diaphragm 1.

In diaphragm 1 of FIG. 6, coating layer 1B is not formed except in the central portion of base layer 1A. In other words, coating layer 1B is formed only on the effective portion. This configuration enables the loudspeaker to have a higher sound pressure level as well as the higher limit frequency to produce clearer sound, without a large increase in the entire weight of diaphragm 1.

Figure 7:
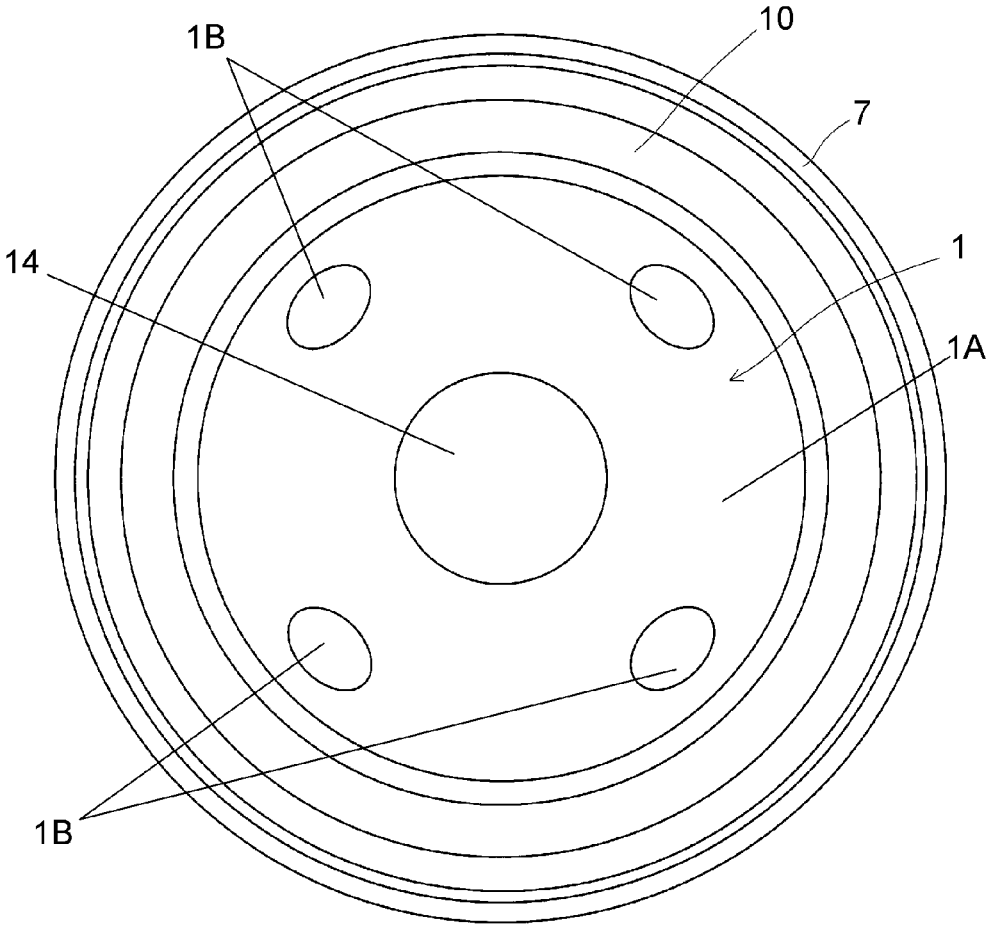
FIG. 7 is a plan view of still another loudspeaker according to the exemplary embodiment of the present disclosure.

Alternatively, coating layer 1B may be formed only on the portion of base layer 1A that is likely to cause unwanted resonance in diaphragm 1 as shown in FIG. 7. FIG. 7 is a plan view of still another loudspeaker according to the exemplary embodiment. This loudspeaker includes a plurality of separate coating layers 1B formed on base layer 1A. These separate coating layers 1B are near the outer periphery of diaphragm 1 and are equally distant from the center of diaphragm 1.

In diaphragm 1 shown in FIG. 7, separate coating layers 1B are formed only on the effective portion in order to. This configuration enables the loudspeaker to have a higher sound pressure level and to produce clearer sound as well as reducing the unwanted resonance, without a large increase in the entire weight of diaphragm 1.

It is preferable that coating layer 1B composed of chitin nanofibers has a thickness in a range from 3 to 20%, inclusive, of the entire thickness of diaphragm 1.

Base layer 1A may contain bamboo cellulose nanofiber.

When the natural fibers composing base layer 1A of diaphragm 1 contains bamboo fibers, the cellulose fibers can be cellulose nanofibers.

A combination of these configurations not only makes coating layer 1B more effective but also makes the fibers of base layer 1A more entangled with each other. This synergistic effect allows the loudspeaker to have the further higher limit frequency and to produce clearer sound.

The loudspeaker according to the present disclosure thus has a good balance of physical properties.

What is claimed is:

1. A loudspeaker diaphragm comprising:

a base layer having a first surface and a second surface, the base layer containing natural fibers; and a coating layer containing chitin nanofibers having a higher elastic modulus than an elastic modulus of the base layer, the coating layer being on at least one of the first surface of the base layer.

2. The loudspeaker diaphragm according to claim 1, wherein the coating layer is one of a first coating layer formed on the first surface of the base layer and a second coating layer formed on the second surface of the base layer, and the loudspeaker diaphragm comprises the first coating layer and the second coating layer.

3. The loudspeaker diaphragm according to claim 1, wherein the coating layer is disposed on a central portion of the loudspeaker diaphragm.

4. The loudspeaker diaphragm according to claim 1, wherein the coating layer is disposed on a portion of the loudspeaker diaphragm where unwanted resonance is likely generated.

5. The loudspeaker diaphragm according to claim 1, wherein each of molecules of the chitin nanofibers is a polysaccharide composed of linearly-linked acetylglucosamine units, and the chitin nanofibers have an average diameter in a range from 10 to 20 nm, inclusive.

6. The loudspeaker diaphragm according to claim 1, wherein the natural fibers are cellulose fibers.

7. The loudspeaker diaphragm according to claim 1, wherein the natural fibers are bamboo cellulose fibers.

8. The loudspeaker diaphragm according to claim 1, wherein the natural fibers include bamboo cellulose nanofibers.

9. The loudspeaker diaphragm according to claim 1, wherein the coating layer has a thickness in a range from 3 to 20%, inclusive, of a thickness of the loudspeaker diaphragm.

10. A method of manufacturing a loudspeaker diaphragm, the method comprising:

spraying a chitin nanofiber water dispersion onto at least one of a first surface and a second surface of a base layer containing natural fibers to form an intermediate product; and hot-pressing the intermediate product into a shape of a diaphragm.

11. A loudspeaker comprising:

the diaphragm according to claim 1;

an edge coupled to an outer periphery of the diaphragm;

a magnetic circuit including a yoke, a magnet, and a plate, the magnetic circuit being provided with a magnetic gap;

a frame attached to the magnetic circuit, and supporting the outer periphery of the diaphragm via the edge;

a voice coil having a first end attached to the diaphragm and a second end wound with a coil disposed in the magnetic gap; and a damper coupled to the frame and the voice coil.

* * * * *